US010537936B2

(12) United States Patent
Schulte-Vorwick et al.

(10) Patent No.: US 10,537,936 B2
(45) Date of Patent: Jan. 21, 2020

(54) APPARATUS FOR FILLING A MELT INTO A CASTING CHAMBER, AND METHOD FOR FILLING MELT INTO A CASTING CHAMBER

(71) Applicant: Bayerische Motoren Werke Aktiengesellschaft, Munich (DE)

(72) Inventors: Lucas Schulte-Vorwick, Landshut (DE); Christian Hirsch, Michelbach Bilz (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 55 days.

(21) Appl. No.: 15/681,958

(22) Filed: Aug. 21, 2017

(65) Prior Publication Data

US 2017/0341138 A1 Nov. 30, 2017

Related U.S. Application Data

(63) Continuation of application No. PCT/EP2016/056666, filed on Mar. 24, 2016.

(30) Foreign Application Priority Data

Mar. 25, 2015 (DE) ..... 10 2015 205 401

(51) Int. Cl.
*B22D 17/30* (2006.01)
*B22D 39/02* (2006.01)
*B22D 41/16* (2006.01)

(52) U.S. Cl.
CPC ..... *B22D 17/30* (2013.01); *B22D 39/026* (2013.01); *B22D 41/16* (2013.01)

(58) Field of Classification Search
CPC ..... B22D 17/30; B22D 17/32; B22D 39/02; B22D 39/023; B22D 39/026; B22D 41/16
See application file for complete search history.

(56) References Cited

U.S. PATENT DOCUMENTS

| | | | | |
|---|---|---|---|---|
| 4,505,307 | A | 3/1985 | Uchida | |
| 2004/0112563 | A1 | 6/2004 | Eljaala et al. | |
| 2004/0191357 | A1 | 9/2004 | Babin | |
| 2008/0169080 | A1 * | 7/2008 | Lellig | B22C 9/088 164/155.2 |

(Continued)

FOREIGN PATENT DOCUMENTS

| | | | |
|---|---|---|---|
| CN | 2912866 | Y | 6/2007 |
| CN | 202655619 | U | 1/2013 |

(Continued)

OTHER PUBLICATIONS

International Search Report (PCT/ISA/210) issued in PCT Application No. PCT/EP2016/056666 dated Jun. 23, 2016 with English translation (seven pages).

(Continued)

*Primary Examiner* — Kevin P Kerns
*Assistant Examiner* — Steven S Ha
(74) *Attorney, Agent, or Firm* — Crowell & Moring LLP

(57) ABSTRACT

An apparatus for introducing a melt into a casting chamber for a die casting operation has a tundish with an inner volume that can be filled with the melt. A method is provided for filling, by way of the apparatus, the melt into the casting chamber for the die casting operation.

4 Claims, 7 Drawing Sheets

(56) References Cited

U.S. PATENT DOCUMENTS

2009/0166387 A1 7/2009 Bigelow et al.

FOREIGN PATENT DOCUMENTS

| | | | |
|---|---|---|---|
| CN | 102935499 | A | 2/2013 |
| CN | 102728829 | B | 6/2014 |
| DE | 1 192 372 | B | 5/1965 |
| DE | 40 28 918 | A1 | 3/1992 |
| DE | 44 40 933 | C1 | 3/1996 |
| DE | 10 2004 057 325 | A1 | 6/2006 |
| DE | 602 24 674 | T2 | 1/2009 |
| EP | 1 512 474 | A1 | 3/2005 |
| GB | 914449 | | 1/1963 |
| GB | 1144424 | A | 3/1969 |
| JP | 53-127766 | A | 11/1978 |
| JP | 6-142883 | A | 5/1994 |
| JP | 6-269918 | A | 9/1994 |
| JP | 7-100615 | A | 4/1995 |
| JP | 7-116811 | A | 5/1995 |
| JP | 2005-118813 | A | 5/2005 |
| WO | WO 03/078095 | A1 | 9/2003 |

OTHER PUBLICATIONS

German-language Written Opinion (PCT/ISA/237) issued in PCT Application No. PCT/EP2016/056666 dated Jun. 23, 2016 (six pages).

German Search Report issued in counterpart German Application No. 10 2015 205 401.2 dated Dec. 22, 2015 with partial English translation (10 pages).

Chinese-language Office Action issued in counterpart Chinese Application No. 201680004583.2 dated Jun. 19, 2018 with English translation (17 pages).

Chinese-language Office Action issued in counterpart Chinese Application No. 201680004583.2 dated Feb. 20, 2019 with English translation (17 pages).

* cited by examiner

APPARATUS FOR FILLING A MELT INTO A CASTING CHAMBER, AND METHOD FOR FILLING MELT INTO A CASTING CHAMBER

CROSS REFERENCE TO RELATED APPLICATIONS

This application is a continuation of PCT International Application No. PCT/EP2016/056666, filed Mar. 24, 2016, which claims priority under 35 U.S.C. § 119 from German Patent Application No. 10 2015 205 401.2, filed Mar. 25, 2015, the entire disclosures of which are herein expressly incorporated by reference.

BACKGROUND AND SUMMARY OF THE INVENTION

The present invention relates to an apparatus for filling a melt into a casting chamber for die casting, having a tundish with an inner volume, wherein the inner volume can be filled with the melt. The invention also relates to a method for filling a melt into a casting chamber for die casting by way of the apparatus.

Modern technology often uses die casting for the series production or mass production of structural parts. In the case of known die-casting methods, in the first instance liquid melt is filled into a casting chamber, in particular by dosing. With the aid of a plunger, the melt in the casting chamber is then accelerated and shot into a mold. There, the melt solidifies to form the component which is to be produced. For the purpose of dosing the melt into the casting chamber, in particular two apparatuses are known from the prior art.

A first such dosing apparatus is constituted by a ladle, which is filled with liquid melt in particular by immersion. For this purpose, the melt may be located for example in a holding furnace. An excess of melt here can flow back into the holding furnace again for example by virtue of the ladle being tilted. In order to fill the melt into the casting chamber, the ladle is positioned over a filling opening in the casting chamber and is emptied into the same by virtue of being tilted.

A further possible way of dosing a melt into a casting chamber is constituted by a closed dosing furnace, in which the liquid melt is located. In order for a casting chamber to be filled, the interior of the dosing furnace is subjected to pressure. The melt can rise up via a riser pipe, which is located beneath a level of the melt in the furnace, and flow into a filling opening of the casting chamber, for example via a channel or a suitable device. When a desired dosing quantity has been reached, the pressure in the furnace is lowered and the filling operation in the casting chamber is thus brought to an end.

The known apparatuses and methods for filling a melt into a casting chamber have a number of disadvantages. Thus, a tapering, parabolic jet of melt forms for example when the melt is being poured out of a ladle into the casting chamber. Said jet impacts on an inner surface of the casting chamber at an uncontrollable angle. The high-level impulse when impact takes place, caused in particular by the high flow speed of the melt, can give rise, even after a short period of time, to erosion on the inner surface of the casting chamber. This wear results in a reduced service life of the casting chamber. High maintenance costs ensue. Furthermore, the high drop height of the melt between the ladle and the inner surface of the casting chamber promotes the formation of turbulence and oxides when impact takes place in the casting chamber. Such oxides, however, can have a negative effect on the properties and on the quality of the component produced.

When use is made of a dosing furnace, the quantity of melt is dosed, as described above, by way of regulation of the positive pressure in the furnace chamber. This procedure is very imprecise and can result in a dosing accuracy of up to +/−2.5%. Different quantities of melt in the casting chamber, however, have a negative effect on the quality of the component to be produced since in the case of a quantity being too low, for example the mold for the component is not completely filled and, in the case of a quantity being too large, the biscuit is unnecessarily large, and has to be melted again in an energy-intensive and costly manner. A high reject rate of the components produced and/or an increase in the production costs as a result of the melting operations which are necessary in addition ensue/ensues. Furthermore, such a dosing system, which is based on positive pressure, is very sluggish, and this has a considerable influence on the cycle time during production of the components.

It is therefore the object of the present invention to eliminate, at least in part, the above described disadvantages of known apparatuses for filling a melt into a casting chamber for die casting, and of methods for filling a melt into a casting chamber for die casting. In particular, it is the object of the present invention to provide an apparatus for filling a melt into a casting chamber for die casting, and a method for filling a melt into a casting chamber for die casting, which straightforwardly and cost-effectively improve the operation of filling a melt into a casting chamber for die casting, wherein in particular wear to the casting chamber is reduced and the quality of the component which is to be produced by the die casting is increased.

As far as a first aspect of the invention is concerned, the above object is achieved by an apparatus for filling a melt into a casting chamber for die casting according to embodiments of the invention. According to a second aspect of the invention, the object is achieved by a method for filling a melt into a casting chamber for die casting according to embodiments of the invention. Features and details here which are described in relation to an apparatus according to the invention of course also apply in relation to a method according to the invention, and vice versa, and therefore reference is or can always be made from one to the other for the disclosure relating to the individual aspects of the invention.

According to a first aspect of the invention, the object is achieved by an apparatus for filling a melt into a casting chamber for die casting, having a tundish with an inner volume, wherein the inner volume can be filled with the melt. An apparatus according to the invention is characterized in that the tundish in the casting chamber can be arranged in a reversible manner over an inner surface of the casting chamber, wherein the tundish has a pouring opening for filling the melt into the casting chamber and also a closure body for opening and closing the pouring opening.

An apparatus according to the invention is designed for filling a melt into a casting chamber for die casting. The melt used here may be, for example, molten aluminum. For this purpose, the apparatus has a tundish with an inner volume. The inner volume here can be filled with the melt. It is essential to the invention that the tundish can be arranged in the casting chamber in a reversible manner over an inner surface of the casting chamber. Arranging over the inner surface of the casting chamber, within the context of the invention, means in particular that the tundish is located, at least in part, in the interior of the casting chamber and the distance between the pouring opening of the tundish and the inner surface of the casting chamber is small. This distance, the so-called outlet gap, is preferably no more than approximately 10-200% of the diameter of the pouring opening and/or less than approximately 15 cm, preferably less than approximately 5 cm, particularly preferably less than approximately 1 cm.

This small outlet gap between the pouring opening and the inner surface of the casting chamber means that a high impact speed of the melt on the inner surface of the casting chamber when the melt is being filled into the casting chamber can be reliably avoided. Erosion on the inner surface of the casting chamber can thus be prevented and the wear to the casting chamber can be reduced overall. A longer service life of the casting chamber can thus be made possible. For the purpose of filling the melt into the casting chamber, the melt is filled beforehand into the inner volume of the tundish. It is contemplated in particular here to monitor the level of the melt in the inner volume of the tundish, for example by a suitable laser and/or ultrasound method and/or eddy-current method. Of course, it is possible here for the apparatus, in particular the tundish, to have the necessary sensors and evaluation devices. Such monitoring of the level in the inner volume can ensure, in particular, a constant quantity of melt in the inner volume of the tundish. Constant filling of the casting chamber with a constant quantity of melt can thus be made possible. On the one hand, this makes possible an increase in the quality of the component which is to be cast, and therefore a reduction in the amount of defective components rejected as a result of the quantity of melt being too small. On the other hand, the biscuit is the necessary size. The production costs of the components can thus be reduced. In particular, provision may also be made, for example, for the inner volume to have a ceramic material and/or a coated metal, in particular a metal coated with a size, at least over part of its surface. This means that all the melt can flow out into the casting chamber. A further increase in the component quality can be achieved in that, once the tundish has been arranged in the vicinity of the inner surface of the casting chamber and the pouring opening has been opened, the tundish remains in this position until all the melt has flown out of the inner volume of the tundish into the casting chamber. The pouring opening is thus below the level of the melt in the casting chamber as soon as this level rises above the outlet gap. This can avoid the situation where the melt, when it is being filled into the casting chamber, penetrates an oxide layer which forms on the surface of the melt in the casting chamber. Turbulence of this oxide layer, and the resulting distribution of this oxide layer in the melt, can thus be avoided. As a result, the purity of the melt in the casting chamber can be enhanced and consequently, in turn, the quality of the component which is to be cast can be increased. Overall, it is thus possible for an apparatus according to the invention to reduce the wear to the casting chamber used and, at the same time, to increase the quality of the die-cast components produced.

Provision may also be made, in the case of an apparatus according to the invention, for the tundish and/or the inner volume to be of funnel-like design. Funnel-like, within the context of the invention, means that the tundish and/or the inner volume are/is, of at least partially conical design. Provision may particularly preferably be made here for the funnel-like tundish to taper in the direction of the pouring opening. Such a funnel-like tundish, in particular the outer shape of the tundish being of funnel-like design, is thus at least partially conical on the outside. This shaping can act as an introduction aid and/or centering aid in a filling opening of the casting chamber. This can facilitate the operation of arranging the tundish over the inner surface of the casting chamber. As a result of a funnel-like inner volume, a melt which is located in the inner volume of the tundish can flow out to particularly good effect through the pouring opening. Provision may particularly preferably be made here for the inner volume to be of funnel-like design to the extent where an internal diameter of the inner volume tapers in the direction of the pouring opening. This makes it possible for the inner volume, when the pouring opening is open, to be emptied in a completely passive manner under the force of gravity alone, no more melt remaining in the interior of the inner volume. A particularly good dosing capability of the quantity of melt which is introduced into the casting chamber can thus be achieved.

Provision may additionally be made, in the case of an apparatus according to the invention, for the closure body to be designed in the form of a valve body for opening and closing the pouring opening, wherein the valve body, in a first position, closes the pouring opening and, in a second position, opens the pouring opening. A valve body here constitutes a particularly straightforward way of providing a closure body. It is particularly preferably possible here for the valve body to be arranged in the interior, or at least essentially in the interior, of the inner volume of the tundish. It is possible here for the valve body, in its first position, to close the pouring opening in the manner of a stopper and to be moved simply in the direction of the interior of the inner volume, into its second position, in order to free the pouring opening and thus to open. This arrangement has, in particular, the advantage that the melt, as a result of the force of gravity, subjects the valve body to a force which pushes the valve body into its first position on the pouring opening. A particularly tight closure of the pouring opening by such a valve body can thus be made possible in a particularly straightforward manner.

In a further development of an apparatus according to the invention, provision may also be made for the valve body to have a contact protrusion which projects out of the tundish, in particular out of the pouring opening, and is designed for establishing contact with the inner surface in the casting chamber, wherein, by virtue of contact being established, the valve body can be moved from its first position into its second position. This contact protrusion is designed in geometrical terms such that it can be used according to the invention, in particular that it is designed for establishing contact with the inner surface in the casting chamber. In particular, provision may be made here for the contact protrusion to project out of the tundish or of the pouring opening over a greater extent than the outlet gap, which remains between the pouring opening and the inner surface of the casting chamber when the tundish is arranged over the inner surface. The contact protrusion thus bridges said distance between the tundish and the inner surface of the casting chamber. When the tundish is arranged over the inner surface of the casting chamber, the contact protrusion thus establishes contact with the inner surface of the casting chamber even before the tundish has assumed its definitive position in the casting chamber. As a result, the valve body is pushed into the interior of the tundish and the pouring opening is thus opened automatically. This constitutes particularly straightforward opening of the pouring opening, since said opening takes place automatically when the tundish is arranged over the inner surface of the casting chamber. High-outlay control mechanisms for opening the pouring opening of the tundish can thus be avoided. An apparatus according to the invention can thus be of relatively straightforward design overall.

Furthermore, an apparatus according to the invention can be designed to provide an elastic element, in particular a spring, of which the force acts on the valve body in the direction of its first position. This elastic element therefore pushes the valve body into its first position, in which the pouring opening is closed by the valve body. In particular when there is no contact protrusion present for the inner surface of the casting chamber, the elastic element therefore causes the pouring opening to close automatically. This is advantageous, in particular, when, once the melt has been filled into the casting chamber, the tundish is removed from the latter again. Such an elastic element thus constitutes a particularly straightforward and advantageous way of providing for automatic closure of the pouring opening by way of the valve body. There is no need for any additional actuators, for example motors. A further simplification in the construction of an apparatus according to the invention can thus be made possible.

In another further development of an apparatus according to the invention, provision may also be made for the valve body, at least in part, to be of plug-shape, plate-shape or trough-shape, in particular omega-trough-shape, design. Provision may particular preferably be made here for these formations of the valve body to be arranged at that end of the valve body at which the melt can flow into the casting chamber. Provision may also, of course, be made for a sealing surface, which can be provided on the valve body for the purpose of establishing contact with a surface of the pouring opening, to correlate with said different embodiments or to be adaptable to said embodiments. The different embodiments here have different advantages. Therefore, a plug-shape configuration of a valve body allows a particularly laminar outflow of the melt into the casting chamber. Problematic turbulence in the melt can thus be avoided. A plate-shape configuration of the valve body can achieve concentric outflow of the melt into the casting chamber. The melt is distributed uniformly in the casting chamber, and this can avoid loading of the casting chamber as would occur for example when the melt impacts at certain points. A trough-shape configuration of the valve body can avoid, for example, sloshing of the melt into the casting chamber, which can be accompanied by the casting chamber being subjected to a high level of local loading. An omega-trough-shape configuration, in which the trough is shaped like the Greek letter omega, can provide in particular the outflow of the melt from the tundish with the preferred direction, which is predetermined by the opening of the omega. In particular the operation of filling an elongate casting chamber can be improved by such an at least partially directed jet of melt.

It is also possible for an apparatus according to the invention to be developed further to the extent where a valve-seat ring is arranged on the pouring opening, and where the valve body has a contact cone, in particular a contact cone of an angle of approximately 5°, for establishing contact with the valve-seat ring. It is preferable here for the valve-seat ring and/or the contact cone to taper in the direction of the first position of the valve body. In particular, provision may also be made for the valve-seat ring and the contact cone to be coordinated with one another. Particularly good sealing of the pouring opening can thus be achieved.

It is also possible for an apparatus according to the invention to be designed, in a further development, such that the valve body is mounted in a linearly movable manner in a bearing. Such a bearing for linear bearing purposes here constitutes a particularly straightforward way of fastening the valve body in a movable manner in a tundish. In particular, such a bearing can provide in a particularly straightforward manner for a linear displacement of the valve body when contact is made between the contact protrusion and the inner surface of the casting chamber. In a further development, provision may additionally be made for an appropriate helical groove and a pin, which is designed for engaging in the groove, to give rise to the linear movement being accompanied by a rotary movement of a few degrees, preferably of approximately 15° or less. It is possible here for the groove to be arranged on the valve body and for the pin to be arranged on the bearing means, or vice versa. The sealing of the pouring opening by way of the valve body can thus be improved further.

According to a particularly preferred embodiment of an apparatus according to the invention, provision may also be made for the tundish to be fixed on a casting channel, wherein the tundish can be filled via the casting channel and can be pivoted together with the casting channel in order to be arranged over the inner surface of the casting chamber. Such a casting channel means that the inner volume of the tundish can be filled particularly straightforwardly. It is also the case that the operation of arranging the tundish over the inner surface of the casting chamber can be done particularly straightforwardly in this embodiment of an apparatus according to the invention. The operation of pivoting the system made up of the tundish and casting channel can be carried out here, for example, by a straightforward shaft with a protuberance. In particular, it is preferably also conceivable for the movement of the tundish or the casting channel to be coupled to a movement of a plunger in the casting chamber, the plunger being provided for the purpose of shooting the melt into the actual mold during the actual die-casting operation. Collision of the tundish, which can be arranged in the casting chamber, and of the plunger, which moves in the casting chamber, can thus be prevented in a particularly straightforward manner.

It is preferably possible for an apparatus according to the invention to be developed to the extent where the tundish and/or casting channel are/is of closed design. Such a closed design can prevent, for example, heat losses from the melt in the inner volume or the casting channel, as a result of which the amount of energy used overall can be cut back. Furthermore, such a covering can also be used for protecting, for example, sensors which is arranged for level-measuring purposes in the interior of the inner volume.

In a further development of an apparatus according to the invention, provision may also be made for the tundish and/or the casting channel to be fillable, or filled, at least in part with an inert gas, in particular with argon. Such an inert gas can prevent, in particular, a reaction of the melt with oxygen, in particular with atmospheric oxygen. This can avoid in particular the formation of an oxide layer on the surface of the melt, as a result of which the purity of the melt, and therefore the quality of a component produced from the melt, can be improved overall.

Provision may also be made, in the case of an apparatus according to the invention, for the tundish to have an overflow opening for limiting a level of the melt in the inner volume. The level of the melt in the inner volume of the tundish can, of course, be monitored by a suitable sensor system, for example by laser sensors and/or ultrasonic sensors and/or sensors for an eddy-current method, in order to ensure a uniform quantity of melt in the inner volume. In the event of the sensor system failing, and/or if there is no such sensor system present, an overflow opening can nevertheless ensure that a certain quantity of melt is not exceeded in the inner volume. If the inner volume is filled with too much melt, this can flow out of the inner volume through the overflow opening. Of course, provision may be made here for the exiting melt to be collected outside the tundish and reused. Such an overflow opening can thus ensure a constant and/or defined quantity of melt in the inner volume of the tundish even if there is no sensor system present or in the event of a sensor system failing.

According to a second aspect of the invention, the object is achieved by a method for filling a melt into a casting chamber for die casting by way of an apparatus, in particular one having the features according to the first aspect of the invention. A method according to the invention is characterized by the following steps:

a) filling the melt into an inner volume of a tundish of the apparatus, b) arranging the tundish over an inner surface of the casting chamber, c) opening a pouring opening of the tundish, for the purpose of filling the melt into the casting chamber, by way of a closure body of the tundish, d) filling the melt into the casting chamber, e) closing the pouring opening by way of the closure body, and f) moving the tundish away from the inner surface.

Provision may particularly preferably be made, in the case of the method according to the invention, for the method to be implemented using an apparatus according to the first aspect of the invention. All the advantages of an apparatus according to the invention, which is designed according to the first aspect of the invention, thus, of course, also apply in the case of a method according to the invention, that is implemented using such an apparatus.

In step a) of the method according to the invention, melt is filled into an inner volume of a tundish. In particular, provision may, of course, be made here for measures to be taken to ensure a constant quantity of melt in the inner volume of the tundish. In step b) of the method according to the invention, the tundish is arranged over an inner surface of the casting chamber. The tundish here is arranged over the inner surface such that an outlet gap, that is to say the distance between a pouring opening of the tundish and the inner surface of the casting chamber, is small. The outlet gap here is preferably smaller than approximately 10% to approximately 200% of a diameter of the pouring opening and/or smaller than approximately 15 cm, preferably smaller than 5 cm, particularly preferably smaller than approximately 1 cm. In step c) of the method according to the invention, a closure body of the tundish opens the pouring opening of the tundish in order to allow the melt to be filled into the casting chamber. This is carried out in step d) of the method according to the invention. The operating of filling the melt into the casting chamber in step d) takes place, in particular, preferably in a passive manner purely by way of the force of gravity acting on the melt. It is preferable here for the tundish to remain in its position over the inner surface of the casting chamber throughout the filling operation in step d). This makes it possible, at least temporarily, for the melt to be filled into the casting chamber beneath a level of the melt therein, as a result of which turbulence of any oxide layer which may be present on the surface of the melt in the casting chamber can be avoided. Following completion of the operation of filling the melt into the casting chamber, the pouring opening is closed in step e) by a movement of the closure body and then, in step f), the tundish is moved away from the inner surface of the casting chamber, in particular is moved all the way out of the casting chamber. Of course, both in steps b) and c) and in steps e) and f), it is contemplated to have at least partially simultaneous execution of the operations of moving the tundish and of opening and closing the pouring opening. A method according to the invention can therefore avoid damage to the inner surface of the casting chamber, in particular as due to erosion, in particular by providing for a small drop height of the melt between the pouring opening and said inner surface. Using the tundish can also achieve a constant quantity of melt for the casting chamber. Overall, it is thus possible for the operation of filling a casting chamber with melt to be simplified, accelerated and rendered more cost-effective.

Provision may also be made, in the case of a method according to the invention, for, in step a), a level of the melt in the inner volume to be monitored, preferably by a laser-measuring method and/or an ultrasonic-measuring method and/or an eddy-current method, in order to determine a quantity of the melt in the inner volume, wherein deposits in the inner volume are taken into account in particular during the operation of determining the quantity. It is, of course, possible here for an apparatus which is designed for implementing a method according to the invention to have the necessary sensor system, for example laser sensors and/or ultrasonic sensors and/or sensors for an eddy-current method, and the evaluation means which are necessary for evaluating purposes. Monitoring the level of the melt in the inner volume, in particular with additional account being taken of deposits in the inner volume, means that a constant quantity of melt in the inner volume, and thus in the casting chamber, can be achieved in a particularly straightforward manner. A particularly effective filling operation in the casting chamber with precisely the correct quantity of melt can thus be achieved in a particularly straightforward and in particular reproducible manner.

It is also possible for a method according to the invention to be developed further to the extent where the tundish, in particular the inner volume, and/or a casting channel, are/is heated, and/or where the tundish, in particular the inner volume, is cleaned prior to step a). Heating of the tundish, in particular the inner volume, can prevent deposits of the melt in the inner volume, since the melt can always be kept in a liquid state by the heating. Deposits which may nevertheless be present can be removed from the tundish, in particular from the inner volume, and/or the casting channel by cleaning. Both measures therefore provide for a deposit-free inner volume, as a result of which a constant quantity of melt in the inner volume can be ensured in a particularly straightforward manner.

Other objects, advantages and novel features of the present invention will become apparent from the following detailed description of one or more preferred embodiments when considered in conjunction with the accompanying drawings.

BRIEF DESCRIPTION OF THE DRAWINGS

Elements having the same function and operation are provided with same reference signs in the individual figures in which, schematically.

DETAILED DESCRIPTION OF THE DRAWINGS

Figure 1:
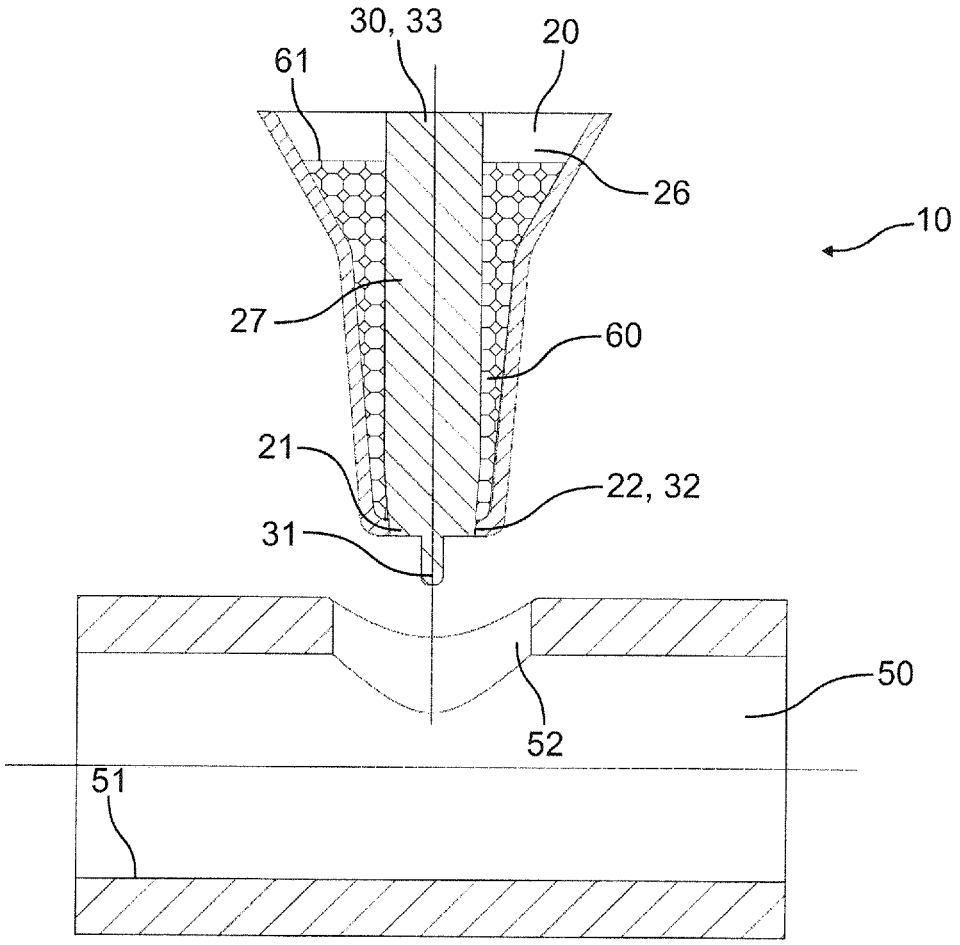
FIGS. 1, 2 and 3 show a first embodiment of an apparatus according to the invention as it implements a method according to the invention.
Figure 2:
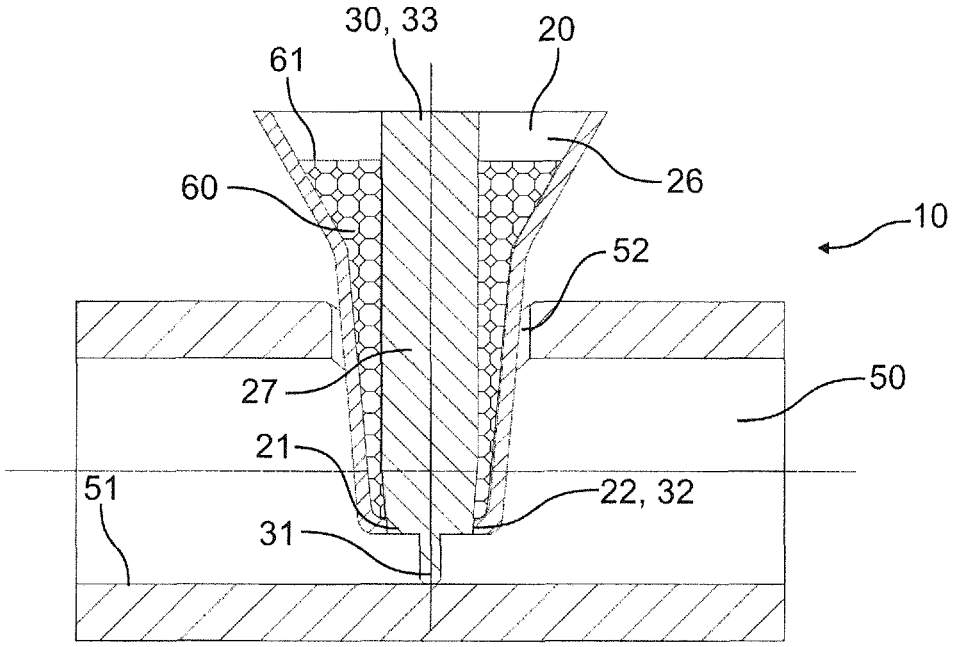
Figure 3:
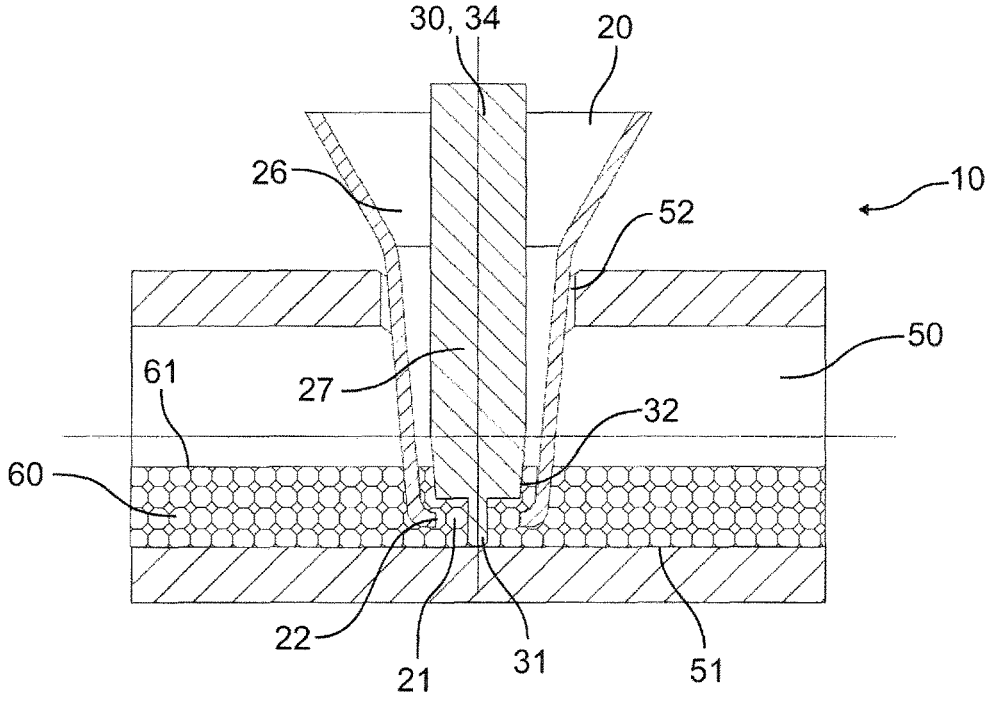

FIGS. 1, 2 and 3 show a first embodiment of an apparatus 10 during different stages of a method according to the invention. FIGS. 1, 2 and 3 will therefore be described together hereinbelow, reference being made to individual figures wherever expedient and necessary. An apparatus 10 is designed for filling a melt 60 into a casting chamber 50. For this purpose, the apparatus 10 has a tundish 20. The tundish 20, furthermore, has an inner volume 26, which can be filled with the melt 60. A pouring opening 21 at the lower end of the tundish 20 is closed by way of a closure body 27, which in the present embodiment is designed in the form of a valve body 30 and, in FIGS. 1 and 2, is located in its first position 33. In particular, the valve body 30 has a contact cone 32, which is adapted to a valve-seat ring 22 of the pouring opening 21. Particularly good sealing of the inner volume 26 of the tundish 20 can thus be achieved, as a result of which the melt 60 can be reliably retained in the inner volume 26 when the pouring opening 21 is closed. A level 61 of the melt 60 in the inner volume 26 can be monitored here, for example by a laser-measuring method and/or ultrasonic-measuring method and/or an eddy-current method, in order to ensure a constant quantity of melt 60 in the inner volume 26. The tundish 20 here is of funnel-shape, that is to say in particular conical, design, as a result of which, in the case of an operation where the tundish 20 is arranged over an inner surface 51 of the casting chamber 50 and where the tundish 20 is introduced, at least in part, into the interior of the casting chamber 50 through a filling opening 52, it is easier for the tundish 20 to be introduced into the casting chamber 50 and it is also possible for the tundish 20 to undergo, for example, self-centering in the filling opening.

FIG. 2 shows the apparatus 10 in which the tundish 20 is shown during step b) of the method according to the invention, that is to say as the tundish 20 is being arranged over the inner surface 51 of the casting chamber 50. The figure depicts, in particular, that the valve body 30 has a contact protrusion 31, which is designed for establishing contact with the inner surface 51 of the casting chamber 50. As the tundish 20 is being lowered further into the casting chamber 50, the contact protrusion 31 prevents the valve body 30 from being lowered further together with the rest of the tundish 20. The valve body 30 is pushed upward relative to the tundish 20. As a result, the pouring opening 21 is freed automatically and thus opened. The melt 60 can then flow out of the inner volume 26, likewise of funnel-shaped design, into the casting chamber 50.

The possibility of arranging the tundish 20 over the inner surface 51 of the casting chamber 20 means that a drop height of the melt 60 from the pouring opening 21 of the tundish 20 onto the inner surface 51 of the casting chamber 50 is small, in particular preferably smaller than approximately 1 cm. This makes it possible to avoid erosion on the inner surface 51, which could be caused by the melt 60 impacting at high speed on the inner surface 51.

FIG. 3 shows the apparatus 10 which is arranged entirely in its definitive position over the inner surface 51 of the casting chamber 50. The contact established by the contact protrusion 31 has pushed the valve body 30 back into the interior of the inner volume 26 of the tundish 20. The pouring opening 21 is open and the melt 60 has already flowed out of the tundish 20 into the casting chamber 50. When the tundish 20 moves upwards, and thus out of the casting chamber 50, the valve body 30 is moved back out of its second position 34, which is shown in FIG. 3, into its first position 33 (see FIGS. 1 and 2), for example merely under the action of the force of gravity. Once the tundish 20 has been removed from the casting chamber 50, a melt 60 located in the casting chamber 50 can be shot into a mold (not included in the figure) by a plunger (not included in the figure), in order for the die-casting operation to be completed. During this operation of the melt 60 being shot in, and/or as the die-casting operation continues, it is already possible for melt 60 to be filled anew into the inner volume 26 of the tundish 20, and this makes it possible to achieve, in particular, a good cycle time for the die-casting operations. Overall, an apparatus 10 according to the invention can thus be achieved such that, on the one hand by virtue of the quantity of melt 60 in the inner volume 26 being monitored, it is possible to ensure a constant filling of the casting chamber 50 with melt 60 and, on the other hand, by virtue of the small drop height of the melt 60 between the pouring opening 21 and the inner surface 51, it is also possible to avoid damage to the casting chamber 50. This makes it possible to cut back overall on costs and time required for carrying out die-casting operations.

Figure 4:
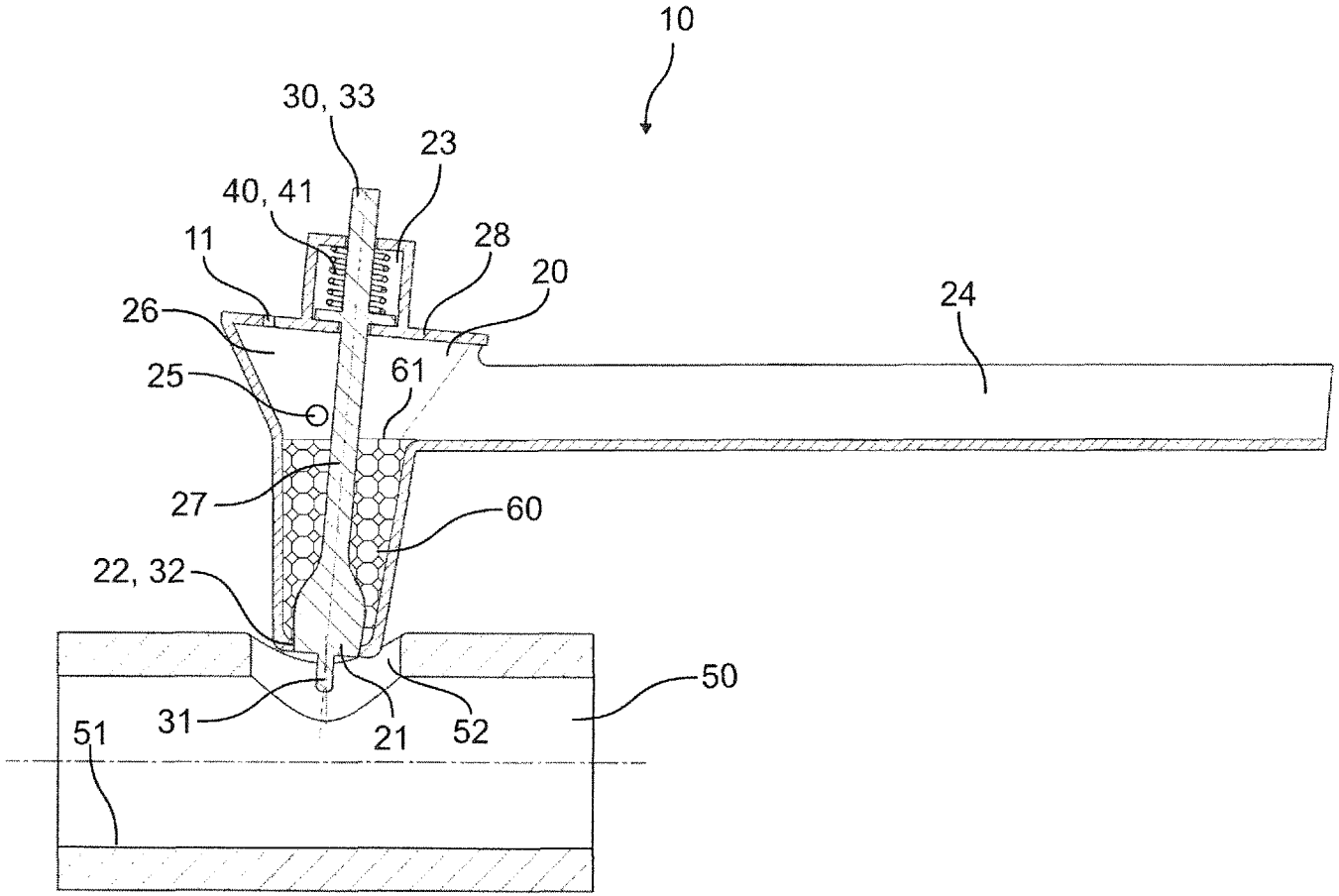
FIGS. 4, 5 and 6 show a second embodiment of an apparatus according to the invention as it implements a method according to the invention.
Figure 5:
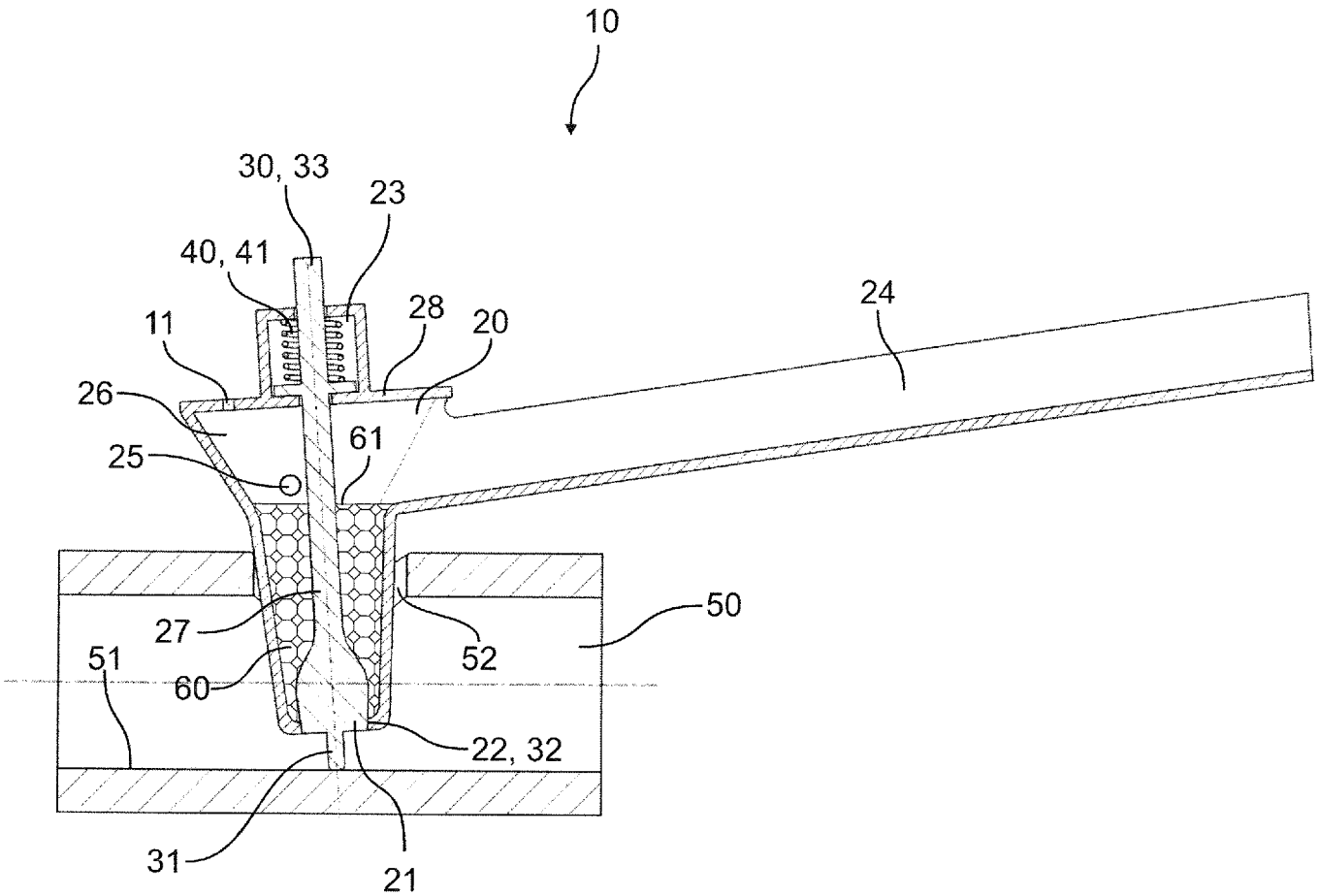
Figure 6:
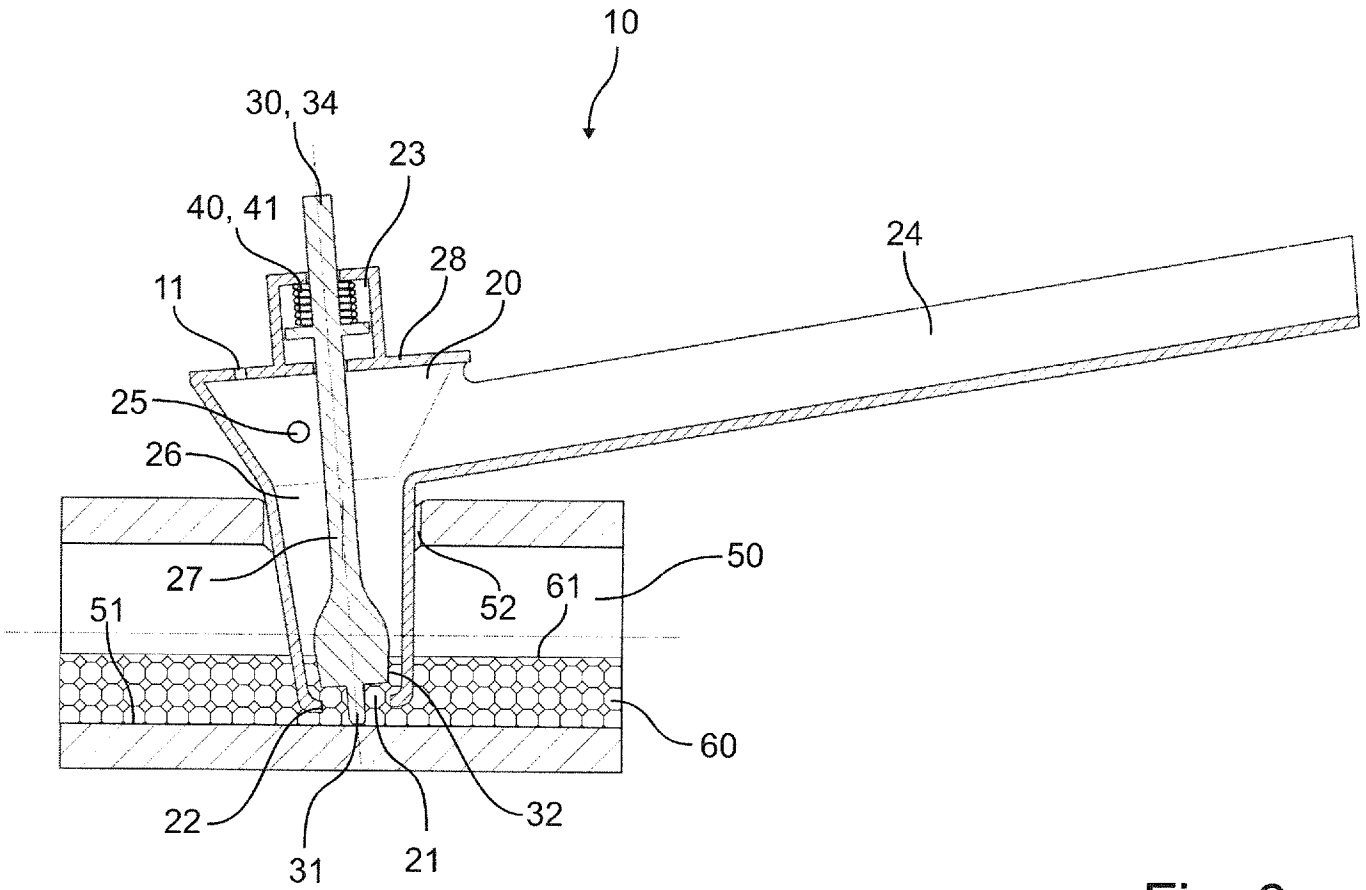

FIGS. 4, 5 and 6 show a further possible embodiment of an apparatus 10, in particular FIGS. 1 and 4, FIGS. 2 and 5 and FIGS. 3 and 6 showing in each case the same point in time of a method according to the invention. All the advantages which have been described in relation to that embodiment of an apparatus according to the invention which is described in FIGS. 1, 2 and 3 thus also apply analogously to those embodiments of an apparatus according to the invention which are described in FIGS. 4, 5 and 6. The following text will therefore deal, in particular, with the differences between the two embodiments. Therefore, for example the embodiment of an apparatus according to the invention which is shown in FIGS. 4, 5 and 6 has a casting channel 24, which is fixed to the tundish 20. As a result, all that is required for arranging the tundish 20 over the inner surface 51 of the casting chamber 50 is a straightforward, joint pivoting movement of the tundish 20 and of the casting channel 24. Such a pivoting movement can be effected, for example, by a shaft with a protuberance (not included in the figure), which acts on the casting channel 24.

Furthermore, the tundish 20 is provided with a cover 28. Energy losses, for example as a result of thermal radiation, from the melt 60 can be reduced, or even avoided altogether, by said cover 28. It is thus possible, for example, to ensure that the melt 60 in the inner volume 26 of the tundish 20 remains liquid throughout the course of the method being implemented. Furthermore, the cover 28 contains a sensor 11, which is designed for monitoring a level 61 of the melt 60 in the inner volume 26 of the tundish 20. This can ensure that a constant quantity of melt 60 is located in the inner volume 26 whenever the method is being implemented.

Furthermore, the tundish 20 depicted has an overflow opening 25. In the event of the sensor 11 failing, melt 60, when the level 61 rises above the height of the overflow opening 25, can flow out of the tundish 20 through said overflow opening. It is thus also the case here that a constant quantity of melt 60 can be ensured in the inner volume 26. Overfilling of the casting chamber 50 with too much melt 60 can thus be reliably avoided.

FIGS. 4, 5 and 6 also show a bearing 23, in which the valve body 30 is mounted in a linearly movable manner. An elastic element 40, in particular a spring 41, pushes the valve body 30 in the direction of its first position 33. This can ensure that the pouring opening 21 is reliably closed by contact being established between the contact cone 32 and the valve-seat ring 22. It is only when the contact protrusion 31 establishes contact with the inner surface 51 of the casting chamber 50 that the valve body 30 is pushed, counter to the force of the spring 41, into the interior of the inner volume 26 and the pouring opening 21 is opened as a result, see FIG. 6. In the case of the tundish 20 then being removed from the casting chamber 50, the spring 41 automatically displaces the valve body 30 back into its first position 33, in which the pouring opening 21 is closed by way of the valve body 30.

Figure 7:
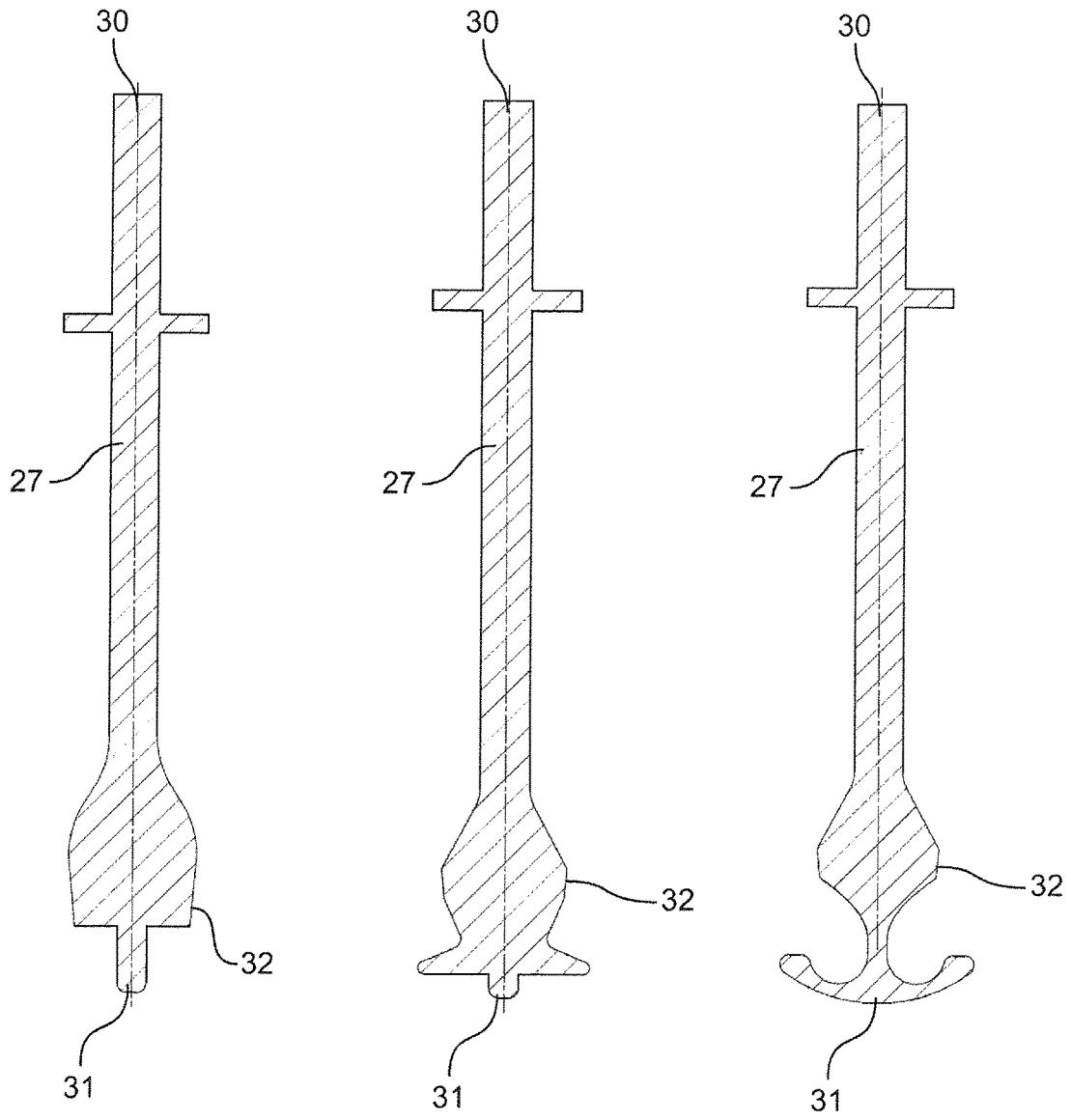
FIG. 7 shows different embodiments of a valve body of an apparatus according to the invention.

FIG. 7 shows three different embodiments of a closure body 27 of an apparatus 10 according to the invention. Each closure body 27 here is designed in the form of a valve body 30. A respective contact protrusion 31 is arranged at the end of the valve body 30 and is designed for establishing contact with an inner surface 51 of a casting chamber 50 (not included in the figure). The valve bodies 30 also each have a contact cone 32, which is designed for establishing contact with a valve-seat ring 22 of the pouring opening 21 in the tundish 20 (not included in the figure) and is also adapted to said valve-seat ring. Particularly tight closure of the pouring opening 21 (not included in the figure) can be achieved as a result.

The three valve bodies 30 shown differ in shape, and this means that the behavior of melt 60 flowing out of the apparatus 10 according to the invention changes in each case. Thus, the left-hand valve body 30 is of plug-shape design. A particularly laminar outflow of the melt 60 from the pouring opening 21 can be achieved as a result.

The central valve body depicted in the middle is of plate-shape design at its lower end. Since the plate-shape formation is arranged between the contact cone and the contact protrusion, said plate-shape formation is located outside the inner volume 26 when the valve body 30 is arranged in an apparatus 10 according to the invention. When the melt 60 flows out of the inner volume 26, it comes into contact with the plate-shape formation and is thus discharged radially, and therefore concentrically, into the casting chamber 50 (not included in the figure). This makes it possible to avoid the situation, in particular, where the melt 60 impacts on the inner surface 51 of the casting chamber 50 at certain points.

The valve body 30 depicted on the right has a trough-shape formation at its lower end. It is also the case that this trough-shape formation is arranged outside the inner volume 26 when an apparatus 10 according to the invention is in its assembled state. Such a trough at the end of the valve body 30 can avoid, in particular, the situation where the melt 60 sloshes as it is being filled into the casting chamber 50. Provision may preferably be made here for the trough to be of omega-shape design. Omega-shape here means that the trough is open in the direction of one side. This means that the melt 60, as it is being filled into the casting chamber 50, flows out preferably in the direction of the opening in the trough, and this makes it possible to have a preferred direction when the casting chamber 50 is being filled. This may be advantageous in particular in the case of elongate casting chambers 50.

LIST OF REFERENCE SIGNS

10 apparatus
11 sensor
20 tundish
21 pouring opening
22 valve-seat ring
23 bearing means
24 casting channel
25 overflow opening
26 inner volume
27 closure body
28 cover
30 valve body
31 contact protrusion
32 contact cone
33 first position
34 second position
40 elastic element
41 spring
50 casting chamber
51 inner surface
52 filling opening
60 melt
61 level of the melt The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A method for filling a melt into a casting chamber for die casting by an apparatus, wherein the apparatus has a tundish with an inner volume Tillable with the melt, the tundish being arrangable in the casting chamber in a reversible manner over an inner surface of the casting chamber and having a pouring opening for filling the melt into the casting chamber and a closure body for opening and closing the pouring opening, wherein the method comprises the acts of:

a) filling the melt into an inner volume of the tundish of the apparatus;

b) arranging the tundish over the inner surface of the casting chamber;

c) opening the pouring opening of the tundish, for the purpose of filling the melt into the casting chamber, by way of establishing a portion of the closure body of the tundish in contact with the inner surface of the casting chamber;

d) filling the melt into the casting chamber;

e) closing the pouring opening by way of the closure body; and f) moving the tundish away from the inner surface.

2. The method as claimed in claim 1, wherein in step a), a level of the melt in the inner volume is monitored, in order to determine a quantity of the melt in the inner volume, wherein deposits in the inner volume are taken into account during the operation of determining the quantity.

3. The method as claimed in claim 2, wherein the monitoring of the level of the melt in the inner volume is carried out by one or more of laser measuring, ultrasonic measuring or eddy-current measuring.

4. The method as claimed in claim 2, further comprising one or more of the following acts:

a) heating the inner volume of the tundish and/or a casting channel, prior to step a), or b) cleaning the inner volume of the tundish prior to step a).

* * * * *